US010286449B2

(12) United States Patent
Minamiguchi et al.

(10) Patent No.: US 10,286,449 B2
(45) Date of Patent: May 14, 2019

(54) CASTING DEVICE AND CASTING METHOD

(71) Applicant: Nissan Motor Co., Ltd., Yokohama-shi, Kanagawa (JP)

(72) Inventors: Satoshi Minamiguchi, Kanagawa (JP); Giichirou Okamura, Kanagawa (JP); Shinichi Tsuchiya, Kanagawa (JP); Hiroyuki Sekiguchi, Kanagawa (JP); Yuuta Sugiyama, Kanagawa (JP); Carl Schubeler, Kanagawa (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 0 days.

(21) Appl. No.: 15/552,695

(22) PCT Filed: Feb. 24, 2015

(86) PCT No.: PCT/JP2015/055183

§ 371 (c)(1),
(2) Date: Aug. 22, 2017

(87) PCT Pub. No.: WO2016/135843

PCT Pub. Date: Sep. 1, 2016

(65) Prior Publication Data

US 2018/0029114 A1 Feb. 1, 2018

(51) Int. Cl.

| | |
|---|---|
| ***B22D 18/06*** | (2006.01) |
| ***B22D 18/04*** | (2006.01) |
| ***B22C 9/06*** | (2006.01) |

(52) U.S. Cl.

CPC ..... *B22D 18/06* (2013.01); *B22C 9/06* (2013.01); *B22C 9/062* (2013.01); *B22D 18/04* (2013.01)

(58) Field of Classification Search

CPC ..... B22D 18/06; B22D 18/04; B22C 9/06; B22C 9/062

USPC ..... 164/61, 63, 65, 254, 255, 256, 257, 258

See application file for complete search history.

(56) References Cited

U.S. PATENT DOCUMENTS

| | | | | |
|---|---|---|---|---|
| 4,791,977 | A | 12/1988 | Chandley | |
| 4,875,518 | A | 10/1989 | Imura et al. | |
| 6,044,893 | A * | 4/2000 | Taniguchi et al. | B22D 17/12 164/113 |

(Continued)

FOREIGN PATENT DOCUMENTS

| | | | |
|---|---|---|---|
| CN | 88102624 | A | 12/1988 |
| CN | 1960822 | A | 5/2007 |

(Continued)

*Primary Examiner* — Kevin P Kerns

(74) *Attorney, Agent, or Firm* — Young Basile Hanlon & MacFarlane, P.C.

(57) ABSTRACT

A casting device includes: a split mold for forming a cavity, including a lower mold, a middle mold that slides in a horizontal direction on the lower mold and an upper mold; a split case for forming a chamber, including a lower case to which the lower mold is attached and an upper case to which the upper mold is attached; a chamber suction device that reduces a pressure at least in the chamber through a chamber pipe that is connected to the chamber and extends to an outside of the chamber; and a cavity suction device that reduces a pressure in the cavity through a cavity pipe that is connected to the cavity and extends to the outside of the chamber. The cavity and the chamber are formed when the middle mold is closed on the lower mold and the split case is closed.

7 Claims, 5 Drawing Sheets

(56) References Cited

U.S. PATENT DOCUMENTS 6,311,758 B1 11/2001 Sakabe et al.

FOREIGN PATENT DOCUMENTS

| | | | | |
|---|---|---|---|---|
| CN | 103624237 | A | 3/2014 | |
| CN | 104028729 | A | 9/2014 | |
| JP | S58196161 | A | 11/1983 | |
| JP | H05169231 | A | 7/1993 | |
| JP | H06-114533 | A | 4/1994 | |
| JP | H0957422 | A | 3/1997 | |
| JP | H10166134 | A | 6/1998 | |
| JP | H11005150 | A | 1/1999 | |
| JP | 2933255 | B2 | 8/1999 | |
| JP | 2000005865 | A | 1/2000 | |
| JP | 4224024 | B2 | 2/2009 | |
| WO | 2004002658 | A1 | 1/2004 | |
| WO | WO 2014/147892 | A1 * | 9/2014 | ..... B22D 18/04 |

* cited by examiner

CASTING DEVICE AND CASTING METHOD

TECHNICAL FIELD

The present invention relates to a casting device and a casting method. In more detail, the present invention relates to a casting device and a casting method in which a combined structure of a predetermined split mold and a predetermined split case and the like is used for filling a cavity with molten metal.

BACKGROUND

A suctioning counter-pressure casting method has been proposed which can be used to cast thin products with reduced heating of molten metal at reduced mold temperature (see JP 2933255B2).

In the suctioning counter-pressure casting method, the lower part of a stalk is dipped in molten metal that is held in the lower part of a pressure-bearable hermetic holding furnace, a horizontally openable mold communicating with the stalk is placed above the stalk in a vertically movable manner, and a hermetic chamber covering the mold is formed. Then, a suction on-off valve in a communication pipe communicated with the hermetic chamber is opened so that the pressure in the hermetic chamber is reduced to 100 Torr within 1 second by mean of a vacuum pump through a vacuum tank. Then, a pressure on-off valve is immediately opened, and compressed air is pumped into the holding furnace by means of a compressor, so that the pressure on the surface of the molten metal is increased to 0.4 to 1 $kg/cm^2$ within 1 second and is maintained at the increased level. When a casting is solidified, the reduced pressure and the maintained increased pressure are released.

However, in the suctioning counter-pressure casting method of JP 2933255B2, the air in the cavity is indirectly suctioned by decompression of the outside thereof. Accordingly, the degree of decompression and the decompression rate depend on the clearance between the mold faces of the split mold, the cavity volume and the volume of the hermetic chamber that surrounds the split mold to cover the entire split mold.

Therefore, for example, a problem in the production of a molded product with such a complex shape that requires the use of a split mold and a core is that only such indirect suction of the air in the cavity by decompression of the outside thereof is not enough to stabilize the degree of decompression and the decompression rate of the cavity within a suitable range, which may result in the degraded filling performance of molten metal.

Another problem with the casting device of JP 2933255B2 is high facility cost due to the hermetical chamber that covers the entire mold.

SUMMARY

The present invention has been made in view of the above-described problems with the prior art. It is an object of the present invention to provide a casting device and a casting method that can reduce the facility cost and also improve the filling performance of molten metal even in the production of a molded product with a such complex shape that requires the use of a split mold and a core.

The present inventors conducted a keen study for achieving the above-described object. As a result, they found that the above-described object can be achieved by a configuration in which a combined structure of a predetermined split mold and a predetermined split case is used to fill a cavity with molten metal. The present invention was thus completed.

That is, the casting device of the present invention includes a split mold, a split case, a chamber suction device and a cavity suction device. The split mold, which is used for forming a cavity, includes a lower mold, a middle mold that slides on the lower mold, and an upper mold. The split case, which is used for forming a chamber, includes a lower case to which the lower mold is attached, and an upper case to which the upper mold is attached. The cavity and the chamber are formed when the middle mold is closed on the lower mold and the split case is closed. The chamber suction device reduces the pressure at least in the chamber through a chamber pipe that is connected to the chamber and extends to the outside of the chamber. The cavity suction device reduces the pressure in the cavity through a cavity pipe that is connected to the cavity and extends to the outside of the chamber. The casting device is configured to produce a molded product by filling the cavity formed by the split mold with molten metal held in a holding furnace disposed below the split mold through a stalk with the upper end connected to a sprue of the split mold and the lower end dipped in the molten metal in the holding furnace. The casting device further includes a compressor that increases the pressure in the holding furnace to supply the molten metal held in the holding furnace at least to the sprue. The cavity suction device supplies the molten metal supplied at least to the sprue further to the entire cavity.

The casting method of the present invention, which is used to produce a molded product by filling a cavity formed by a split mold with molten metal held in a holding furnace disposed below the split mold through a stalk with the upper end connected to a sprue of the split mold and the lower end dipped in the molten metal in the holding furnace, involves: Step (1) of using the split mold for forming the cavity, which includes a lower mold, a middle mold that slides on the lower mold and an upper mold, and a split case for forming a chamber, which includes a lower case to which the lower mold is attached and an upper case to which the upper mold is attached, to close the middle mold on the lower mold and to close the split case so as to form the cavity and the chamber; after Step (1), Step (3) of reducing the pressure at least in the chamber by means of a chamber suction device through a chamber pipe that is connected to the chamber and extends to the outside of the chamber; and after Step (1), Step (4) of reducing the pressure in the cavity by means of a cavity suction device through a cavity pipe that is connected to the cavity and extends to the outside of the chamber, wherein the method further involves: after Step (1) and before Step (3) and Step (4), Step (2) of increasing the pressure in the holding furnace by means of a compressor to supply the molten metal held in the holding furnace at least to the sprue, wherein, in Step (4), the molten metal supplied at least to the sprue is supplied further to the entire cavity. According to the present invention, in the production of molded products by filling the cavity, which is formed by the split mold, with the molten metal, which is held in the holding furnace disposed below the split mold, through the stalk with the upper end connected to the sprue of the split mold and the lower end dipped in the molten metal in the holding furnace, the split mold for forming the cavity, which includes the lower mold, the middle mold that slides on the lower mold and the upper mold, and the split case for forming the chamber, which includes the lower case to which the lower mold is attached and the upper case to which the upper mold is attached, are used to close the middle mold on the lower mold and to close the split case so that the cavity and the chamber are formed, and then the pressure at least in the chamber is reduced by means of the chamber suction device through the chamber pipe that is connected to the chamber and extends to the outside of the chamber, and the pressure in the cavity is reduced by means of the cavity suction device through the cavity pipe that is connected to the cavity and extends to the outside of the chamber, the pressure in the holding furnace is increased by means of a compressor so that the molten metal held in the holding furnace is supplied at least to the sprue, and the molten metal supplied at least to the sprue is supplied further to the entire cavity by means of the cavity suction device. Therefore, it is possible to provide a casting device and a casting method that can reduce the facility cost and also improve the filling performance of molten metal even in the production of a molded product with such a complex shape that requires the use of a split mold and a core.

DETAILED DESCRIPTION OF THE EMBODIMENTS

Hereinafter, a casting device and a casting method according to an embodiment of the present invention will be described in detail. The dimension of the drawings that are referred to in the following description may be exaggerated for descriptive reasons and may therefore be different from the actual dimension.

First Embodiment

Figure 1:
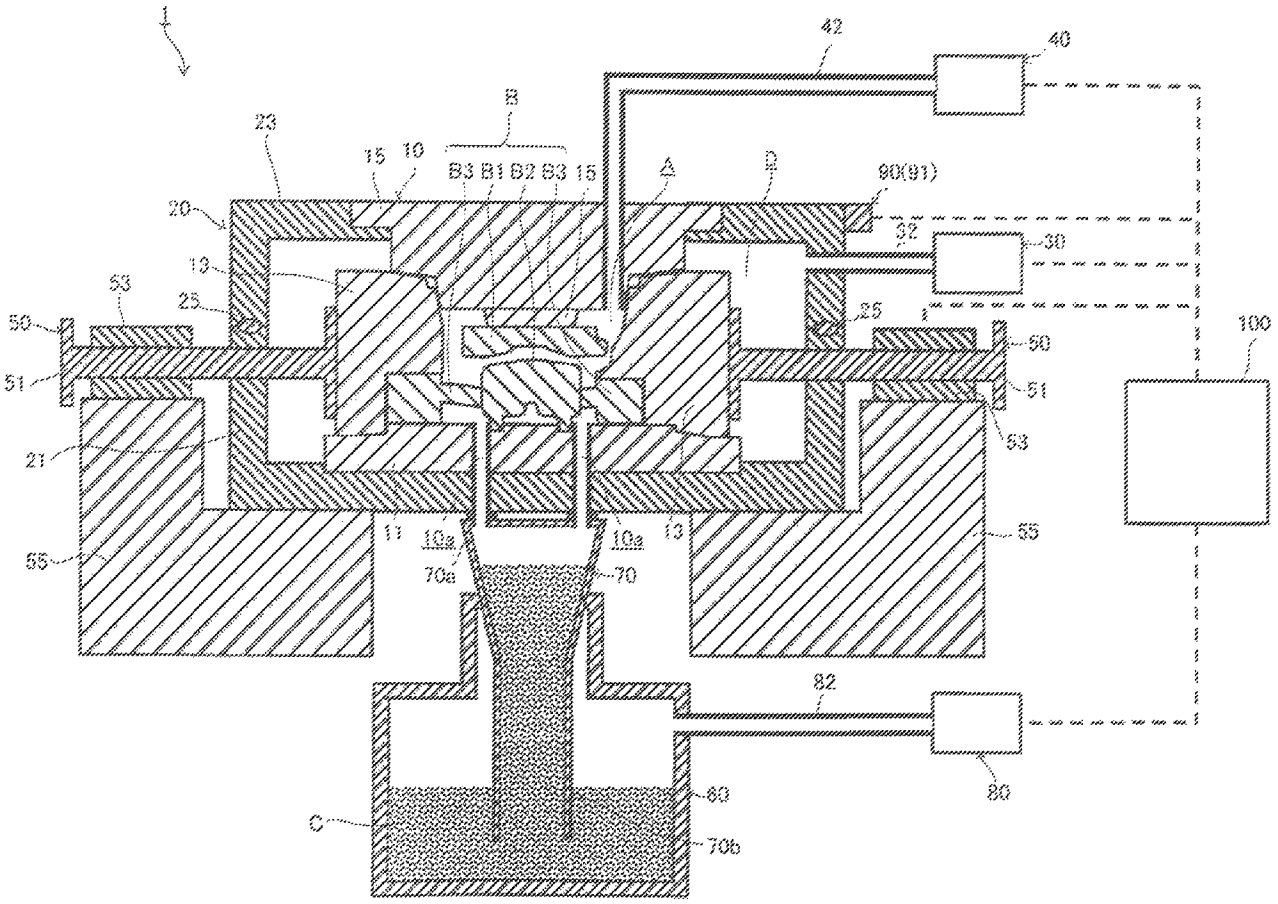
FIG. 1 is a schematic explanatory view of a casting device according to a first embodiment of the present invention.
Figure 2:
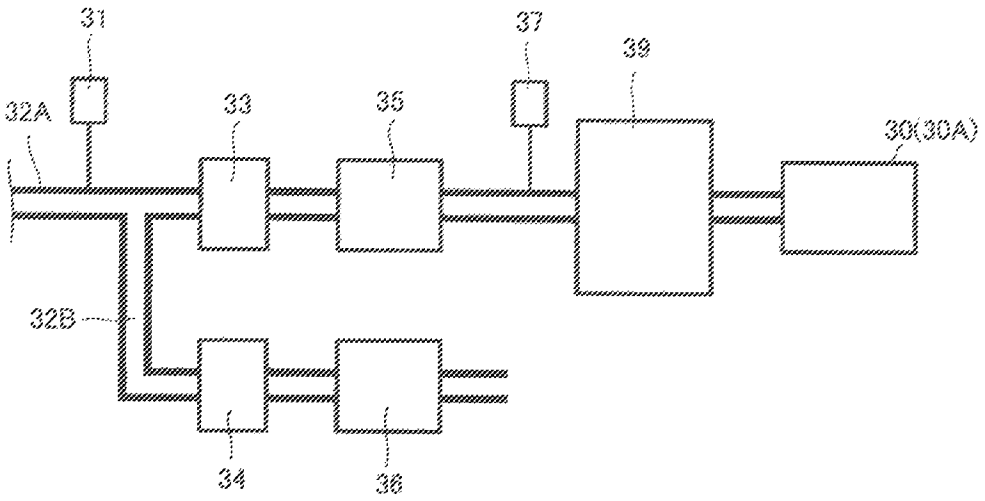
FIG. 2 is a schematic explanatory view of a chamber pipe and a chamber suction device in FIG. 1.

First, a casting device according to a first embodiment of the present invention will be described in detail referring to the drawings. FIG. 1 is a schematic explanatory view of the casting device according to the first embodiment of the present invention. FIG. 2 is a schematic explanatory view of a chamber pipe and a chamber suction device in FIG. 1.

As illustrated in FIG. 1, the casting device 1 according to the embodiment includes a split mold 10, a split case 20, a chamber suction device 30, a cavity suction device 40, a cylinder 50, a holding furnace 60, a stalk 70, a compressor 80, a sensor 90 and a controller 100. For example, the casting device 1 is used for producing molded products such as cylinder heads (not shown) by filling a cavity A with molten metal C such as aluminum or an aluminum alloy, in which a core B composed of a top core B1, a water jacket core B2 and a port core B3 is disposed in the cavity A.

The split mold 10, which is used for forming the cavity A, includes a lower mold 11, a middle mold 13 that slides in the horizontal direction on the lower mold 11, and an upper mold 15. Further, the split mold 10 is constituted by a mold known in the art that can be used for the molten metal C such as aluminum or an aluminum alloy C. The core B and a core print attached thereto are also constituted by a core and a core print known in the art that can be used for the molten metal C such as aluminum or an aluminum alloy.

The split case 20, which is used for forming the chamber D, includes a lower case 21 to which the lower mold 11 is attached, and an upper case 23 to which the upper mold 15 is attached. A rubber sealing member 25 is disposed at the contact portion between the lower case 21 and the upper case 23 to ensure the sealing between them. The split case 20 is constituted by any member that is resistant to pressure and heat, e.g. the change in pressure and temperature in the casting step. For example, the split case may be made of the same material as the split mold. However, the split case may be made of a different material. Alternatively, for example, the split case may be constituted by different members according to the use environment thereof. Although not shown in the figure, the lower mold and the lower case are detachable from each other, and the upper mold and the upper case are also detachable from each other.

The cavity A and the chamber D are formed when the middle mold 13 is closed on the lower mold 11 and the split case 20 is closed.

The chamber suction device 30 reduces the pressure at least in the chamber D through a chamber pipe 32 that is connected to the chamber D and extends to the outside of the chamber D. It is preferred, but not particularly limiting, that the chamber pipe 32 is disposed in the upper case 23 where it is less affected by a leakage of molten metal to the chamber D.

The chamber pipe and the chamber suction device will be described in detail with the drawings.

As illustrated in FIG. 2, for example, the chamber suction device 30 includes a pump 30A for vacuuming (reducing the pressure in) a hermetic room to a vacuum condition or near-vacuum condition. Further, as illustrated in FIG. 2, a pressure sensor 31 for detecting the pressure in the chamber D, a throttle valve 33 for adjusting the suction flow rate in the main pipe 32A, an on-off valve 35 for controlling the suction through the main pipe 32A, a pressure sensor 37 for detecting the suction pressure of the chamber suction device 30 and a tank 39 for removing foreign matters suctioned during the suction are provided in a main pipe 32A of the chamber pipe to which the chamber suction device 30 is installed. Further, as illustrated in FIG. 2, a throttle valve 34 for adjusting the suction flow rate in the sub pipe 32B and an on-off valve 36 for controlling the suction through the sub pipe 32B are provided in a sub pipe 32B that is branched from the main pipe 32A, which are used for releasing the chamber to the atmosphere.

The cavity suction device 40 reduces the pressure in the cavity A through a cavity pipe 42 that is connected to the cavity A and extends to the outside of the chamber D. Although not shown in the figure, the cavity pipe and the cavity suction device have the same configuration as the above-described chamber pipe and the chamber suction device. Further, although not shown in the figure, a porous material is disposed at the connection part to the cavity of the cavity pipe to prevent invasion of molten metal.

The cylinder 50 is used to slidably move the middle mold 13 in the horizontal direction. For example, the cylinder 50 includes a cylinder rod 51, a cylinder 53 and a holder 55. However, the present invention is not limited thereto, and an actuator known in the art may be employed instead. The holder 55 also function as a holder of the split mold 20. It is preferred, but not particularly limiting, that the cylinder rod 51 penetrates the lower case 21. This is because the lower case 21 is barely moved compared to the upper case 23, and it is not necessary to move it along with the cylinder. Although not shown in the figure, a sealing member is disposed between the cylinder rod and the lower case, which ensures the sealing between them but barely interrupt the sliding movement of the cylinder rod. Further, although not shown in the figure, a similar cylinder may be further provided to slidably move the upper mold in the vertical direction.

The holding furnace 60 is disposed outside the chamber D and is located below the split mold 10 when the cavity A is formed. The holding furnace 20 holds molten metal C.

The stalk 70 serves as a channel of the molten metal C that fills the cavity A. The upper end 70*a* of the stalk 70 is connected to a sprue 10*a* of the split mold 10, and the lower end 70*b* is dipped in the molten metal C that is held in the holding furnace 60. Although not shown in the figure, a porous material known in the art is disposed in the sprue.

The compressor 80 increases the pressure in the holding furnace 60 through a pipe 82 connected to the holding furnace 60. By the compression, the compressor 80 may supply the molten metal C in the holding furnace 60 to the sprue 10*a*.

The sensor 90 may include, for example, a mold closure sensor 91 for detecting closure of a mold, however the sensor 90 is not limited thereto. That is, although not shown in the figure, the sensor 90 may further include a molten metal sprue arrival sensor for detecting the molten metal reaching the sprue, a cavity molten metal filling sensor for detecting the cavity being filled with the molten metal, a cavity molten metal solidification sensor for detecting solidification of the molten metal in the cavity.

For example, the mold closure sensor 91 may be constituted by a positioning sensor known in the art.

For example, the molten metal sprue arrival sensor may be constituted by a temperature sensor disposed near the sprue, a surface level sensor or a pressure sensor disposed in the holding furnace, or the like.

For example, the cavity molten metal filling sensor may be constituted by a temperature sensor or a pressure sensor disposed in the cavity pipe near the cavity or a surface level sensor or a pressure sensor disposed in the holding furnace, or the like.

For example, the cavity molten metal solidification sensor may be constituted by a temperature sensor disposed in a cavity pipe near the cavity.

The controller 100 may be constituted by, for example, an integrated or independent controller that controls the compressor 80 based on an input from the mold closure sensor 91, controls the chamber suction device 30 based on an input from at least one of the mold closure sensor 91 and the compressor 80 and controls the cavity suction device 40 based on an input from at least one of the mold closure sensor 91 and the compressor 80.

When such a controller is used, control data for controlling compression and suction based on positions, pressures, temperatures, the elapse of time since the mold is closed and the like may be stored in the controller, which were obtained beforehand, for example, by a preliminary experiment.

However, the controller is not limited to such controllers as described above. That is, although not shown in the figure, the controller may be, for example, constituted by an integrated or independent controller that controls the compressor based on an input from at least one of the mold closure sensor, the compressor, the molten metal sprue arrival sensor, the cavity molten metal filling sensor and the cavity molten metal solidification sensor, controls the chamber suction device based on an input from at least one of the mold closure sensor, the compressor, the molten metal sprue arrival sensor, the cavity molten metal filling sensor and the cavity molten metal solidification sensor, and controls the cavity suction device based on an input from at least one of the mold closure sensor, the compressor, the molten metal sprue arrival sensor, the cavity molten metal filling sensor and the cavity molten metal solidification sensor.

When this controller is used, for example, compression and suction may be controlled based on the actual position, the temperature, the pressure and the like without using the elapse of time since the mold is closed. Of course, control data for controlling compression and suction based on pressures and temperatures obtained beforehand in a preliminary experiment may be stored in the controller. The above-described control data can be suitably determined by a preliminary experiment using the above-described sensors such as the mold closure sensor, the molten metal sprue arrival sensor, the cavity molten metal filling sensor and the cavity molten metal solidification sensor.

In the production of molded products, the casting device 1 uses the split mold 10, which includes the lower mold 11, the middle mold 13 that slides in the horizontal direction on the lower mold 11 by means of the cylinder 50 and the like and the upper mold 15, and the split case 20, which includes the lower case 21 to which the lower mold 11 is attached and the upper case 23 to which the upper mold 15 is attached, to close the middle mold 13 on the lower mold 11 and to close the split case 20 so as to form the cavity A and the chamber D.

In the production of molded products, the chamber suction device 30 of the casting device 1 reduces the pressure in the chamber D through the chamber pipe 32 that is connected to the chamber D and extends to the outside of the chamber D.

In the production of molded products, the cavity suction device 40 of the casting device 1 reduces the pressure in the cavity A through the cavity pipe 42 that is connected to the cavity A and extends to the outside of the chamber D. In this step, the cavity suction device 40 itself may supply the molten metal C to the entire cavity A. Alternatively, the compressor 80 may supply the molten metal C at least to the sprue 10*a* as described above, and the cavity suction device 40 may then supply it further to the entire cavity A.

Further, in the production of molded products, the compressor 80 of the casting device 1 may increase the pressure in the holding furnace 60 through the pipe 82 connected to the holding furnace 60 so as to supply the molten metal C in the holding furnace 60 to the sprue 10*a*.

As described above, the casting device, which includes the predetermined split mold, the split case, the chamber suction device and the cavity suction device, closes the middle mold on the lower mold of the predetermined split mold and closes the predetermined split case so as to form the cavity and the chamber, and then reduces the pressure in the chamber by means of the predetermined chamber suction device and also directly reduces the pressure in the cavity by means of the predetermined cavity suction device. This can reduce the facility cost and also improve the filling performance of molten metal.

That is, the volume of the chamber can be reduced by using a predetermined structure that includes the split mold, which includes the lower mold, the middle mold that slides on the lower mold in the horizontal direction and the upper mold, and the split case, which includes the lower case to which the lower mold is attached and the upper case to which the upper mold is attached, and that forms the cavity and the chamber when the middle mold is closed on the lower mold and the split case is closed. As a result, the filling performance of molten metal can be improved, e.g. a reduction of defects due to entrapped air, an increase of the casting speed and the like can be achieved.

As described later, when the cavity suction device is used to directly reduce the pressure in the cavity, it is possible to reduce the dependency of the degree of decompression and the decompression rate on the clearance between the mold faces of the split mold and the volume of the chamber around the cavity. Accordingly, the degree of decompression and the decompression rate can be stabilized within a suitable range. An exemplary suitable size of the gap at the side of the split mold in the chamber is such that a molded product can be collected by sliding the middle mold in the horizontal direction. However, it is not limited thereto. The reduction of the chamber volume enables reduction of the facility cost. Further, along with the reduction of the chamber volume, it also become possible to reduce the size of the chamber suction device and the like compared to ones in the prior art, which enables further reduction of the facility cost. Further, the cylinder may be disposed outside the chamber. In this case, for example, the workability in a mold interior cleaning step, a core setting preparation step, a core air blowing step and the like, which are described later, can be improved.

The cavity suction device is used to directly reduce the pressure in the cavity through the cavity pipe that is connected to the cavity and extends to the outside of the chamber. This can reduce the dependency of the degree of decompression and the decompression rate on the clearance between the mold faces of the split mold, the volume of the cavity and the volume of the chamber surrounding the cavity. Therefore, the degree of decompression and the decompression rate can be stabilized within a suitable range. As a result, the filling performance of molten metal can be improved, e.g. an increase of the casting speed can be achieved.

The chamber suction device is used to reduce the pressure in the chamber through the chamber pipe that is connected to the chamber and extends to the outside of the chamber. This can reduce or prevent inflow of air through the clearance between the mold faces of the split mold, which may occur when only the cavity suction device is used to directly reduce the pressure in the cavity. As a result, the filling performance of the molten metal can be improved, e.g. a reduction of defects caused by entrapped air can be achieved.

In the casting device of the embodiment, which is used to produce molded products by filling the cavity formed by the split mold with the molten metal held in the holding furnace disposed below the split mold through the stalk with the upper end connected to the sprue of the split mold and the lower end dipped in the molten metal in the holding furnace as described above, it is preferred that the casting device includes the compressor that supplies the molten metal in the holding furnace at least to the sprue by increasing the pressure in the holding furnace, and the cavity suction device that supplies the molten metal having been supplied at least to the sprue further to the entire cavity. With this configuration, the filling performance of the molten metal can be further improved.

That is, when the compressor is used to increase the pressure in the holding furnace to supply the molten metal at least to the sprue, it is not necessary to supply the molten metal held in the holding furnace to the sprue by means of suction through the cavity with such a complex shape that requires the use of a split mold and a core. Accordingly, it is not necessary to count the resistance to suction flow in the cavity with a complex shape, which is an impediment to improvement of the filling performance. Further, inflow of air through the clearance between the mold faces of the split mold is reduced or prevented, which may occur when only the cavity suction device is used to directly reduce the pressure in the cavity. As a result, the energy loss in the production can be reduced compared to the case in which only the cavity suction device is used to supply the molten metal to the entire cavity. Further, the filling performance of molten metal can also be improved, e.g. a reduction of defects caused by entrapped air can be achieved.

It is effective to apply the present invention to low-pressure casting in which a cavity is filled with molten metal at low speed at low pressure than die-casting in which a cavity is filled with molten metal at high speed at high pressure, but the present invention is not particularly limited thereto. This is because the air that is originally present or flows in in low-pressure casting is more likely to degrade the filling performance of molten metal than the air that flows in in die-casting.

It is preferred that the casting device of the embodiment includes the mold closure sensor for detecting closure of the mold and the integrated or independent controller that controls the compressor based on a signal from the mold closure sensor, controls the chamber suction device based on a signal from at least one of the mold closure sensor and the compressor and controls the cavity suction device based on a signal from at least one of the mold closure sensor and the compressor as described above.

As described above, the predetermined suction (decompression) by means of the chamber suction device and the predetermined suction (decompression) by means of the cavity suction device are performed along with the predetermined compression by means of the compressor. This enables further reduction of the energy loss in the production, stabilization of the casting speed within a suitable range and reduction of defects caused by entrapped air. As a result, the filling performance of molten metal can be further improved.

Second Embodiment

Figure 3:
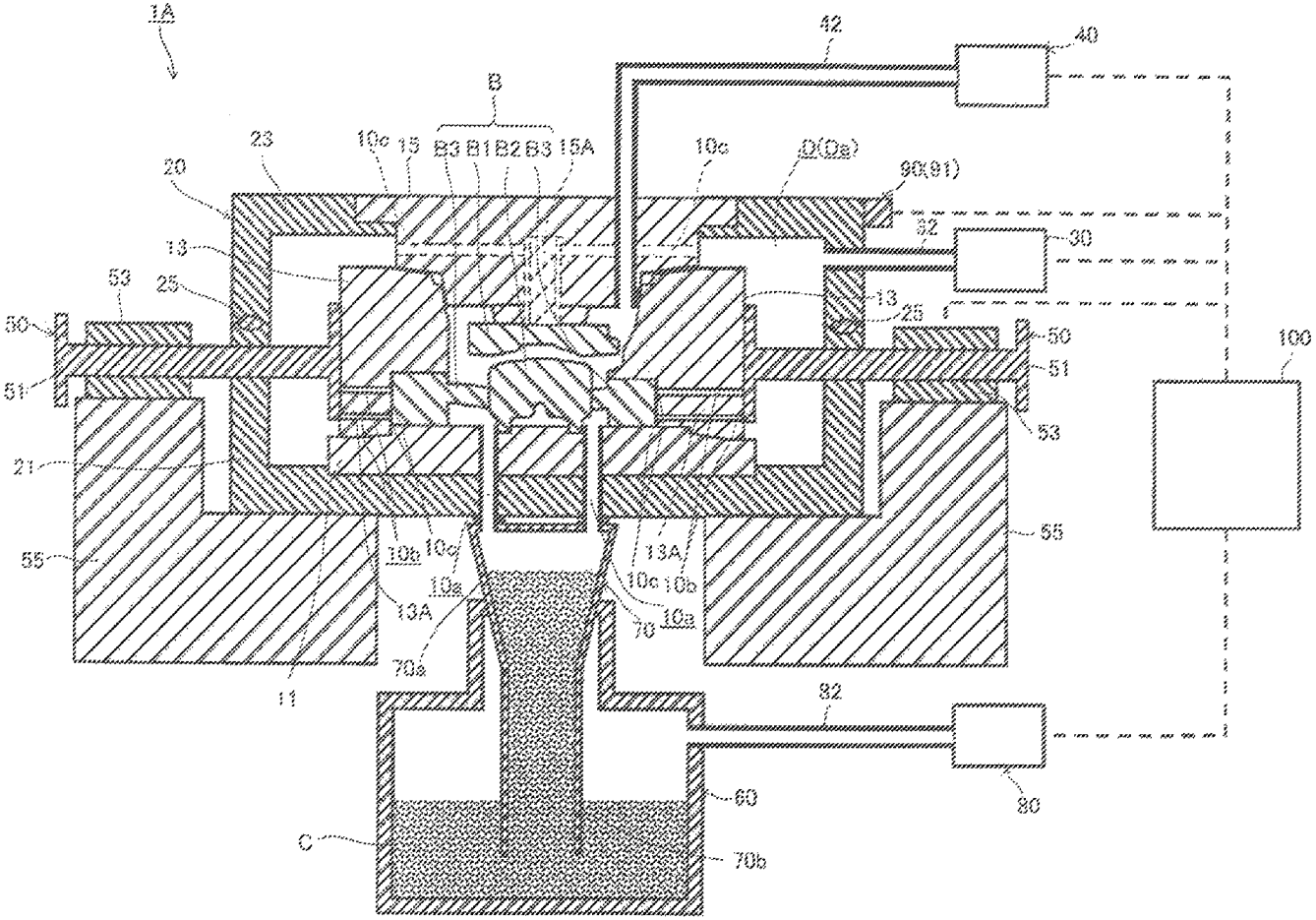
FIG. 3 is a schematic explanatory view of a casting device according to a second embodiment of the present invention.

Next, a casting device according to a second embodiment of the present invention will be described in detail referring to the drawings. FIG. 3 is a schematic explanatory view of the casting device according to the second embodiment of the present invention. The same reference signs denote the same components as those of the previously-described embodiment, and the description thereof is omitted.

As illustrated in FIG. 3, the casting device 1A of the embodiment is different in that a split mold 10 includes communication pathways 10*b* that communicate a cavity A with a space Da of a chamber D around the split mold 10. The communication pathways denoted by reference signs 10*b*, which are illustrated by dashed lines in FIG. 3, are disposed at the positions where they do not interfere with a chamber pipe 42. Further, as illustrated in FIG. 3, a top core B1 and port cores B3 are disposed at suction openings 10*c* of the communication pathways 10*b*. The components denoted by reference signs 13A and 15A, which are illustrated respectively by solid lines and a dashed line, are steel members that are made of the same material as a middle mold 13 and an upper mold 15 and are used for forming the extremely narrow communication pathways 10*a*.

As for the suctioning counter-pressure casting method of Patent Document 1, it is not considered at all to apply it to the production of molded products with such a complex shape that requires the use of a split mold and a core. Therefore, in the production of molded products with such a complex shape that requires the use of a split mold and a core, a gas defect may be caused by core gas that is produced by combustion of an adhesive and the like of the core when molten metal comes in contact with the core, which may degrade the filling performance of molten metal.

In contrast, in the casting device of the embodiment, the split mold has the communication pathways that communicate the cavity with the chamber space surrounding the split mold as described above. This enables releasing core gas through the communication pathways, which is produced by combustion of the adhesive contained in the core when molten metal comes in contact with the core, and thereby enables suppressing the increase of the cavity pressure. As a result, even when core gas cannot be discharged through the cavity pipe, the core gas and the like can be discharged through the communication pathways. Therefore, the filling performance of molten metal can be improved, e.g. a reduction of gas defects can be achieved.

An example of such communication pathways is an extremely narrow pathway that has large flow resistance compared to the cavity pipe. With this configuration, the pressure is not immediately reduced along with the decompression of the chamber. However, when core gas and the like cannot be directly discharged from the cavity through the cavity pipe so that the pressure in the cavity is increased, the core gas and the like can be discharged through the communication pathways.

In the casting device of the embodiment, it is preferred that the cores or the core prints attached to the cores are disposed at the suction openings of the communication pathways as described above.

When the cores or the core prints attached to the cores are disposed at the suction openings of the communication pathways as described above, core gas can be efficiently released through the communication pathways and the chamber pipe, which is produced by combustion of the adhesive and the like contained in the core when molten metal comes in contact with the cores. Further, this configuration enables further stabilization of the casting speed within a suitable range and reduction of defects caused by entrapped air. As a result, the filling performance of molten metal can be further improved, e.g. a further reduction of gas defects can be achieved.

In addition, in the casting device of the embodiment, it is preferred that the communication pathway is formed at at least one of the positions of in the middle mold, in the upper mold and between the middle mold and the upper mold.

When the communication pathway is formed in the middle mold or the upper mold or between them, core gas can be efficiently released through the communication pathway and the chamber pipe, which is produced by combustion of the adhesive and the like contained in the core when molten metal comes in contact with the cores. Further, this configuration enables further stabilization of the casting speed within a suitable range and reduction of defects caused by entrapped air. As a result, the filling performance of molten metal can be further improved, e.g. a further reduction of gas defects can be achieved.

Third Embodiment

Next, a casting method according to a third embodiment of the present invention, specifically a casting method using the casting device according to the first or second embodiment of the present invention will be described in detail. It is preferred to use the casting device of the present invention in the casting method of the present invention, however the usage of the casting device of the present invention is not necessarily required.

The casting method of the embodiment involves Step (1), Step (3) and Step (4). Step (1) involves using a split mold for forming a cavity, which includes a lower mold, a middle mold that slides in the horizontal direction on the lower mold and an upper mold, and a split case for forming a chamber, which includes a lower case to which the lower mold is attached and an upper case to which the upper mold is attached, to close the middle mold on the lower mold and to close the split case so as to form the cavity and the chamber. Step (3), which is performed after Step (1), involves reducing the pressure at least in the chamber by means of a chamber suction device through a chamber pipe that is connected to the chamber and extends to the outside of the chamber. Step (4), which is performed after Step (1), preferably after Step (3), involves reducing the pressure in the cavity by means of a cavity suction device through a cavity pipe that is connected to the cavity and extends to the outside of the chamber.

In this way, the split mold for forming the cavity, which includes the lower mold, the middle mold that slides in the horizontal direction on the lower mold and the upper mold, and the split case for forming the chamber, which includes the lower case to which the lower mold is attached and the upper case to which the upper mold is attached, are used to close the middle mold on the lower mold and to close the split case so that the cavity and the chamber are formed, the pressure at least in the chamber is reduced by means of the chamber suction device through the chamber pipe that is connected to the chamber and extends to the outside of the chamber, and the pressure in the cavity is reduced by means of the cavity suction device through the cavity pipe that is connected to the cavity and extends to the outside of the chamber. This enables reduction of the facility cost and improvement of the filling performance of molten metal, for example, even in the production of molded products with such a complex shape that requires the use of a split mold and a core.

In the production of molded products by filling the cavity, which is formed by the split mold, with molten metal, which is held in the holding furnace disposed below the split mold, through a stalk with the upper end connected to the sprue of the split mold and the lower end dipped in the molten metal held in the holding furnace, it is preferred that the casting method of the embodiment further involves Step (2) of increasing the pressure in the holding furnace by means of a compressor so as to supply the molten metal in the holding furnace at least to the sprue after Step (1) and before Step (3) and Step (4), and Step (4) of supplying the molten metal having been supplied at least to the sprue further to the entire cavity. With this configuration, the filling performance of molten metal can be further improved.

That is, when the compressor is used to increase the pressure in the holding furnace so as to supply the molten metal at least to the sprue, it is not necessary to supply the molten metal in the holding furnace to the sprue by means of suction through the cavity with such a complex shape that requires the use of a split mold and a core. Therefore, it is not necessary to count the resistance to suction flow in the cavity with a complex shape, which is an impediment to improvement of the filling performance. Further, inflow of air through the clearance between the mold faces of the split mold and the like is reduced or prevented, which may occur when only the cavity suction device is used to directly reduce the pressure in the cavity. As a result, compared to the case in which only the cavity suction device is used to supply the molten metal to the entire cavity, the energy loss in the production can be reduced. Furthermore, the filling performance of molten metal can be improved, e.g. a reduction of defects caused by entrapped air can be achieved.

In the casting method of the embodiment, it is preferred that a predetermined suction (decompression) by means of the cavity suction device and a predetermined suction (compression) by means of the chamber suction device are performed when the predetermined compression by means of the compressor is performed.

The predetermined compression by means of the compressor involves starting compression of inside of the holding furnace by means of the compressor, maintaining the compression of inside of the holding furnace by means of the compressor until the molten metal reaches the sprue, further continuing or maintaining the compression of inside of the holding furnace by means of the compressor until the molten metal is supplied to the entire cavity, further continuing or maintaining the compression of inside of the holding furnace by means of the compressor until the molten metal in the entire cavity is solidified, and thereafter terminating the compression of inside of the holding furnace by means of the compressor.

The predetermined suction (decompression) by means of the chamber suction device involves starting decompression of inside of the chamber by means of the chamber suction device through the chamber pipe connected to the chamber after the compression of inside of the holding furnace by means of the compressor is started and before the molten metal reaches the sprue, then continuing or maintaining the decompression of inside of the chamber by means of the chamber suction device through the chamber pipe until the molten metal is supplied to the entire cavity, further continuing or maintaining the decompression of inside of the chamber by means of the chamber suction device through the chamber pipe until the molten metal in the entire cavity is solidified, and thereafter terminating the decompression of inside of the chamber by means of the chamber suction device through the chamber pipe when the compression of inside of the holding furnace by means of the compressor is terminated. It is preferred, but not particularly limiting, that the pressure in the chamber is lower than the pressure in the cavity (described later) with regard to their achieved. This configuration enables reduction of the number of defects caused by entrapped air and therefore enables improvement of the filling performance of molten metal.

The predetermined suction (decompression) by means of the cavity suction device involves starting decompression by means of the cavity suction device through the cavity pipe connected to the cavity when the molten metal reaches the sprue, then continuing the decompression of the cavity by means of the cavity suction device through the cavity pipe until the molten metal is supplied to the entire cavity, and thereafter terminating the decompression by means of the cavity suction device through the cavity pipe after the molten metal is supplied to the entire cavity and before the decompression of inside of the chamber by means of the chamber suction device through the chamber pipe is terminated.

In this way, the predetermined suction (decompression) by means of the cavity suction device and the predetermined suction (decompression) by means of the chamber suction device are performed when the predetermined compression by means of the compressor is performed. This enables further reduction of the energy loss in the production, further stabilization of the casting speed within a suitable range and reduction of defects caused by entrapped air. As a result, the filling performance of molten metal can be further improved.

In the casting method of the embodiment, it is preferred that the decompression of the cavity by means of the chamber suction device through the above-described communication pathways and the chamber pipe is started while the decompression of inside of the chamber by means of the chamber suction device through the chamber pipe is continued or maintained until the molten metal is supplied to the entire cavity or while the decompression of inside of the chamber by means of the chamber suction device through the chamber pipe until the molten metal in the entire cavity is solidified; and thereafter the decompression of the cavity by means of the chamber suction device through the above-described communication pathways and the chamber pipe is terminated when the compression of inside of the holding furnace by means of the compressor is terminated.

As described above, the split mold has the above-described communication pathways. This enables releasing core gas through the communication pathways and the chamber pipe, which is produced by combustion of the adhesive and the like contained in the core when the molten metal comes in contact with the cores. As a result, the filling performance of molten metal can be further improved, e.g. a reduction of gas defects can be achieved.

Figure 4:
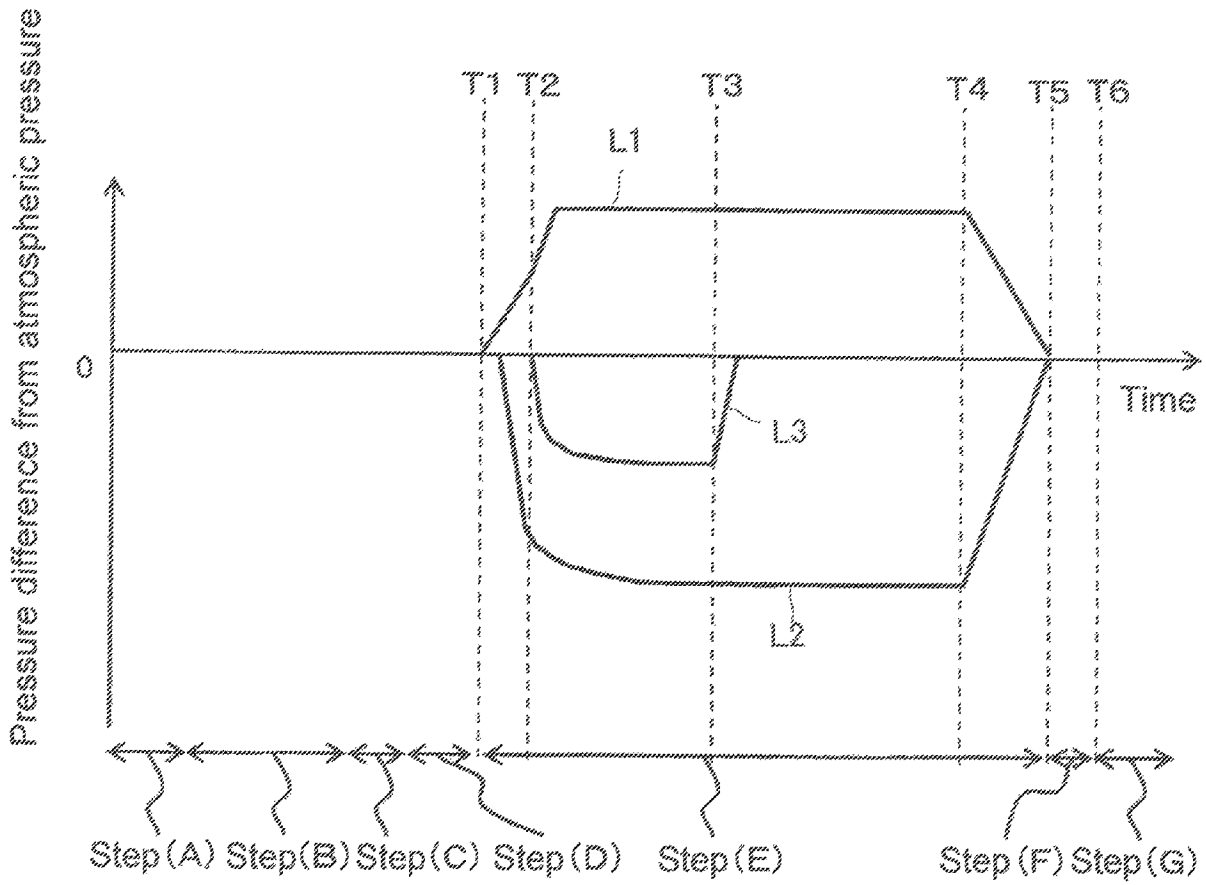
FIG. 4 is an explanatory view schematically illustrating an example of a casting method using the casting device according to the first or second embodiment of the present invention.

Hereinafter, the casting method of the embodiment will be described in detail referring to the drawings. FIG. 4 is an explanatory view schematically illustrating an example of the casting method using the casting device according to an embodiment of the present invention.

As illustrated in FIG. 4, the exemplary casting method involves a mold interior cleaning step (Step (A)), a core setting preparation step (Step (B)), a core air-blowing step (Step (C)) and a mold closing step (Step (D)) known in the art as pre-steps of a casting step of Step (E). Further, the casting method involves a cooling step (Step (F)) and a mold opening step (Step (G)) known in the art as post-steps of the casting step.

In the figure, L1 is the pressure in the holding furnace. For example, the value detected by a pressure sensor disposed in a pipe can be used as the pressure. However, it is not limited thereto. For example, the value of compression force of the compressor may also be used as the pressure. L2 is the pressure in the chamber. For example, the value detected by a pressure sensor disposed in the chamber pipe can be used as the pressure. However, it is not limited thereto. For example, the decompression force of the chamber suction device can be used as the pressure. L3 is the pressure in the cavity. For example, the value detected by a pressure sensor disposed in the cavity pipe can be used as the pressure. However, it is not limited thereto. For example, the decompression force of the cavity suction device can be used as the pressure.

First, as illustrated by L1, the compression of inside of the holding furnace by means of the compressor is started at T1, which is the time when the mold is closed. Then, the compression of inside of the holding furnace by means of the compressor is continued until T2, which is the time when the molten metal reaches the sprue. The compression of inside of the holding furnace by means of the compressor is further continued until T3, which is the time when the molten metal is supplied to the entire cavity. The compression of inside of the holding furnace by means of the compressor is further continued until T4, which is the time when the molten metal in the entire cavity is solidified. Thereafter, the compression of inside of the holding furnace by means of the compressor is terminated. T5 is the time when the compression by means of the compressor (and the decompression by means of the chamber suction device, which is described below) is terminated. T6 is the time when the temperature of a molded product is decreased so that the product has sufficient strength to be released from the mold.

As illustrated by L2, the decompression of inside of the chamber by means of the chamber suction device through the chamber pipe connected to the chamber is started between T1, which is the time when the compression of inside of the holding furnace by means of the compressor is started, and T2, which is the time when the molten metal reaches the sprue. Then, the decompression of inside of the chamber by means of the chamber suction device through the chamber pipe is continued until T3, which is the time when the molten metal is supplied to the entire cavity. The decompression of inside of the chamber by means of the chamber suction device through the chamber pipe is further continued until T4, which is the time when the molten metal in the entire cavity is solidified. Thereafter, the decompression of inside of the chamber by means of the chamber suction device through the chamber pipe is terminated at T5, which is the time when the compression of inside of the holding furnace by means of the compressor is terminated.

As illustrated by L3, the decompression of the cavity by means of the cavity suction device through the cavity pipe connected to the cavity is started at L2, which is the time when the molten metal reaches the sprue. Then, the decompression of the cavity by means of the cavity suction device through the cavity pipe is continued until T3, which is the time when the molten metal is supplied to the entire cavity. Thereafter, the decompression of the cavity by means of the cavity suction device through the cavity pipe is terminated between T3, which is the time when the molten metal is supplied to the entire cavity, and the time when the decompression of inside of the chamber by means of the chamber suction device through the chamber pipe is terminated.

Figure 5:
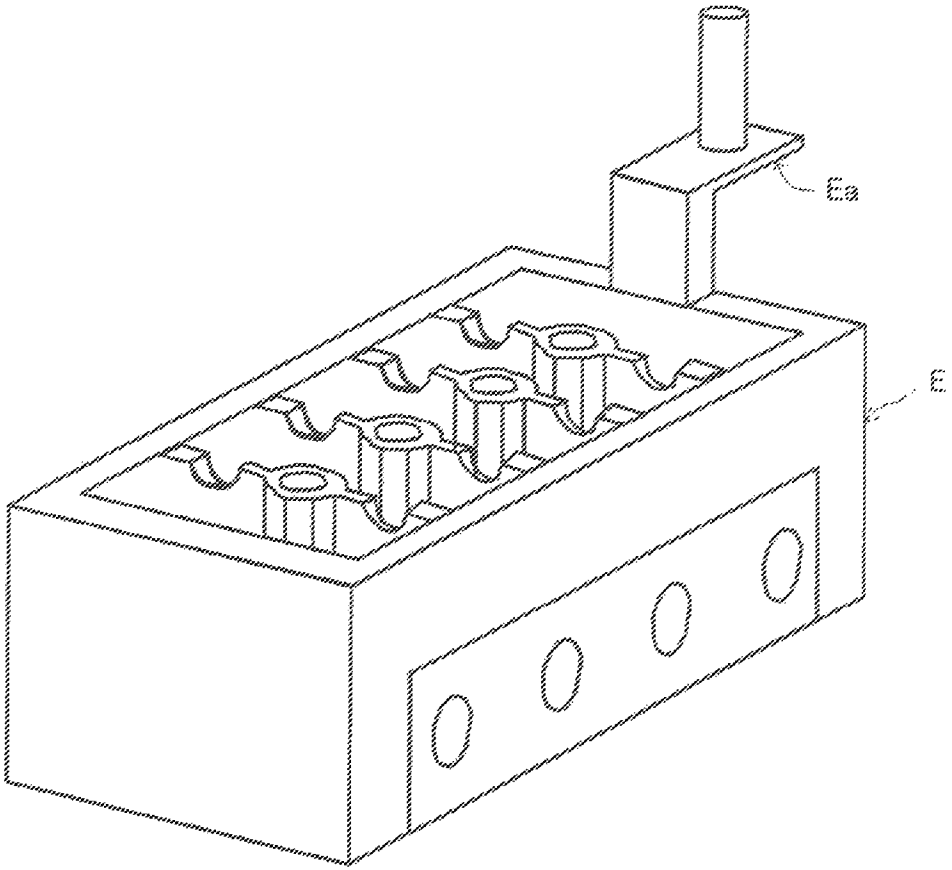
FIG. 5 is a schematic perspective view of a molded product that is obtained by another example of the casting method using the casting device according to the first or second embodiment of the present invention.

Next, a molded product obtained by the casting will be described in detail referring to the drawings. FIG. 5 is a schematic perspective view of a molded product obtained by another example of the casting method using the casting device according to the first or second embodiment of the present invention.

As illustrated in FIG. 5, the molded product E is a cylinder head made of an aluminum alloy, which has the shape corresponding to the cavity of a split mold. In the figure, Ea denotes a fin derived from a communication pathway or a cavity pipe.

While the present invention is described with a few embodiments, the present invention is not limited thereto, and various changes can be made within the features of the present invention.

For example, the above-described embodiments are examples in which the molten metal is aluminum or an aluminum alloy. However, the present invention is not limited thereto and is also applicable to, for example, iron, copper, brass and the like.

For example, the above-described embodiments are examples in which the molded product with such a complex shape that requires the use of a split mold and a core is a cylinder head. However, the present invention is not limited thereto, and is also applicable to a cylinder block.

For example, the above-described embodiments are examples in which the cylinder is disposed outside the chamber. However, the present invention is not limited thereto, and the cylinder may be disposed inside the chamber.

Further, for example, the above-described embodiments are examples in which the compressor for increasing the pressure in the holding furnace is used to supply the molten metal to the sprue. However, the present invention is not limited thereto, and an electromagnetic pump may be used to supply the molten metal at least to the sprue instead of the compressor.

REFERENCE SIGNS LIST

1, 1A Casting device
10 Split mold
10*a* Sprue
10*b* Communication pathway
10*c* Suction opening
11 Lower mold
13 Middle mold
13A, 15A Steel member
15 Upper mold
20 Split case
21 Lower case
23 Upper case
25 Rubber sealing member
30 Chamber suction device
30A Pump
31, 37 Pressure sensor
32 Chamber pipe
32A Main pipe
32B Sub pipe
33, 34 Throttle valve
35, 36 On-off valve
39 Tank
40 Cavity suction device
42 Cavity pipe
50 Cylinder
51 Cylinder rod
53 Cylinder
55 Holder
60 Holding furnace
70 Stalk
70*a* Upper end
70*b* Lower end
80 Compressor
82 Pipe
90 Sensor
91 Mold closure sensor
100 Controller
A Cavity
B Core
B1 Top core
B2 Water jacket core
B3 Port core
C Molten metal
D Chamber
Da Space
E Molded product
Ea Fin

The invention claimed is:

1. A casting device, comprising:

a split mold configured to form a cavity, comprising a lower mold, a middle mold that slides on the lower mold, and an upper mold;

a split case configured to form a chamber, comprising a lower case to which the lower mold is attached and an upper case to which the upper mold is attached, in which the cavity and the chamber are formed when the middle mold is closed on the lower mold and the split case is closed;

a chamber suction device configured to reduce a pressure in the chamber through a chamber pipe that is connected to the chamber and extends to an outside of the chamber; and a cavity suction device configured to directly reduce a pressure in the cavity through a cavity pipe that is directly connected to the cavity and extends to the outside of the chamber, wherein the casting device is configured to produce a molded product by filling the cavity formed by the split mold with molten metal held in a holding furnace disposed below the split mold through a stalk with an upper end connected to a sprue of the split mold and a lower end dipped in the molten metal in the holding furnace, the casting device further comprises a compressor configured to increase the pressure in the holding furnace to supply the molten metal held in the holding furnace at least to the sprue, the cavity suction device is configured to supply the molten metal supplied at least to the sprue further to the entire cavity, and the chamber suction device reduces the pressure in the chamber to an achieved chamber pressure, which is lower than an achieved cavity pressure in the cavity achieved through reducing the pressure in the cavity by the cavity suction device.

2. The casting device according to claim 1, wherein a through hole is formed in a center part of the upper case, the upper mold is fitted in the through hole so as to be integrated with the upper case, and the cavity pipe is constituted by a through hole formed in the upper mold.

3. The casting device according to claim 1, wherein when the middle mold is closed, the chamber and the cavity are fluidly disconnected.

4. The casting device according to claim 1, wherein an internal area of the cavity pipe is un-obstructed.

5. The casting device according to claim 1, further comprising a molten metal sprue arrival sensor for detecting the molten metal reaching the sprue and a controller that controls the cavity suction device based on an input from the molten metal sprue arrival sensor.

6. A casting method which is used to produce a molded product by filling a cavity formed by a split mold with molten metal held in a holding furnace disposed below the split mold through a stalk with an upper end connected to a sprue of the split mold and a lower end dipped in the molten metal in the holding furnace, comprising:

Step (1) of using the split mold configured to form the cavity, the split mold comprising a lower mold, a middle mold that slides on the lower mold and an upper mold, and a split case configured to form a chamber, the split case comprising a lower case to which the lower mold is attached and an upper case to which the upper mold is attached, to close the middle mold on the lower mold and to close the split case so as to form the cavity and the chamber;

after Step (1), Step (3) of reducing a pressure in the chamber to an achieved chamber pressure by means of a chamber suction device through a chamber pipe that is connected to the chamber and extends to an outside of the chamber; and after Step (1), Step (4) of directly reducing a pressure in the cavity to an achieved cavity pressure by means of a cavity suction device through a cavity pipe that is directly connected to the cavity and extends to the outside of the chamber, wherein the method further comprises: after Step (1) and before Step (3) and Step (4), Step (2) of increasing a pressure in the holding furnace by means of a compressor to supply the molten metal held in the holding furnace at least to the sprue, wherein, in Step (4), the molten metal supplied at least to the sprue is supplied further to the entire cavity and the achieved chamber pressure of the pressure in the chamber is lower than the achieved cavity pressure of the pressure in the cavity.

7. The casting method according to claim 6, wherein in the step (2), a molten metal sprue arrival sensor detects the molten metal reaching the sprue, and in the step (4), a controller controls the cavity suction device based on an input from the molten metal sprue arrival sensor to supply the molten metal supplied at least to the sprue further to the entire cavity.

* * * * *